United States Patent [19]

Boidron

[11] 4,429,680

[45] Feb. 7, 1984

[54] OPEN FIRE CONVECTOR

[76] Inventor: Michel Boidron, 136, avenue du Mēdoc, Le Vigean, 33320 Eysines, France

[21] Appl. No.: 295,458

[22] Filed: Aug. 24, 1981

Related U.S. Application Data

[63] Continuation of Ser. No. 40,383, May 18, 1979, abandoned.

[30] Foreign Application Priority Data

May 18, 1978 [FR] France ..... 78 14701

[51] Int. Cl.[3] ..... F24B 7/00

[52] U.S. Cl. ..... 126/121; 176/242; 176/143

[58] Field of Search ..... 126/121, 131, 122, 143, 126/245, 242; 237/51

[56] References Cited

U.S. PATENT DOCUMENTS

| | | | |
|---|---|---|---|
| 313,998 | 3/1885 | Deardorff | 126/131 |
| 529,972 | 11/1894 | Tatem | 126/131 X |
| 1,314,968 | 9/1919 | Maritzen | 126/131 |

FOREIGN PATENT DOCUMENTS

| | | | |
|---|---|---|---|
| 2260275 | 6/1973 | Fed. Rep. of Germany | 126/143 |
| 2270527 | 12/1975 | France | 126/143 |
| 2273238 | 12/1975 | France | 126/143 |
| 2274001 | 1/1976 | France | 126/131 |

*Primary Examiner*—Samuel Scott
*Assistant Examiner*—Randall L. Green
*Attorney, Agent, or Firm*—William A. Drucker

[57] ABSTRACT

A hot air generator is constituted by cast iron plates assembled together and sheets of steel cut out and bent in order to rest on elongated plane elements with which the plates are provided, perpendicularly to their surface, in such a manner as to form a closed shallow conduit.

A first horizontal portion of the conduit, provided with a drawer which serves as an ash pan and as an adjustable member for leading in external air, forms the hearth and a chamber for preheating of the air. Two vertical portions serve as chambers for slowing down and for heating the air. The second vertical portion is constituted by the rear face of a throat of moulded cast iron which permits the conventional operation of the fireplace.

2 Claims, 10 Drawing Figures

Fig. 8
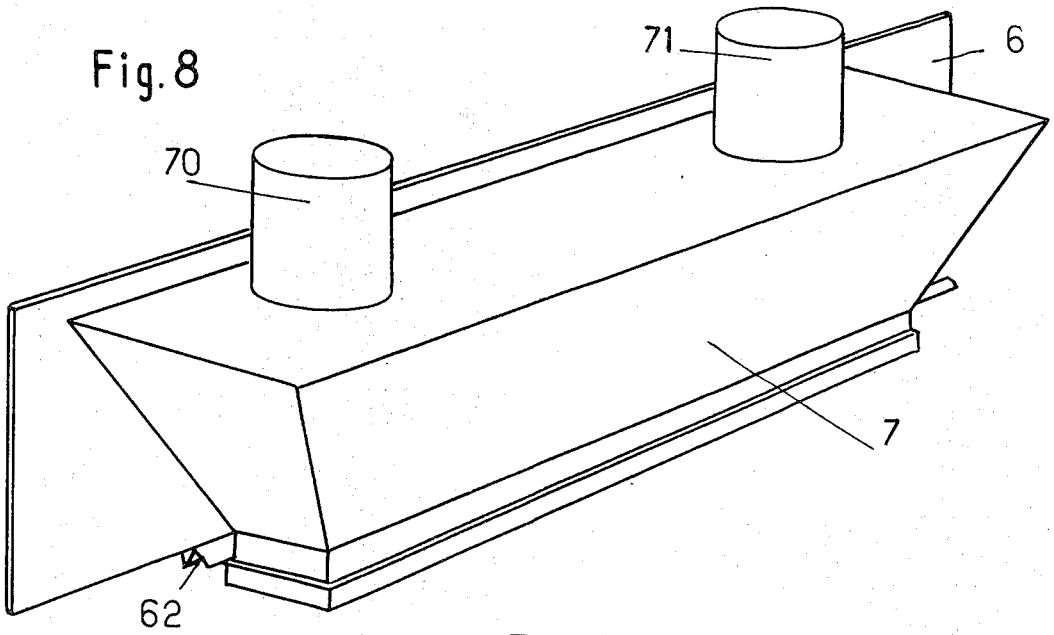
Fig. 9
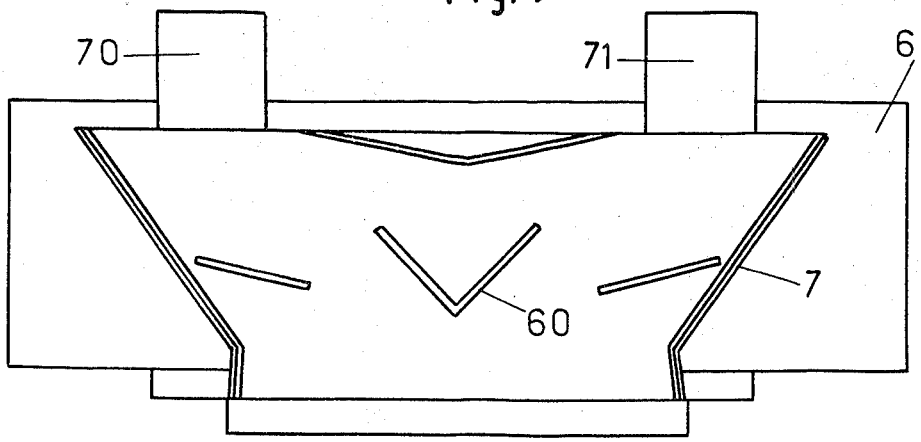
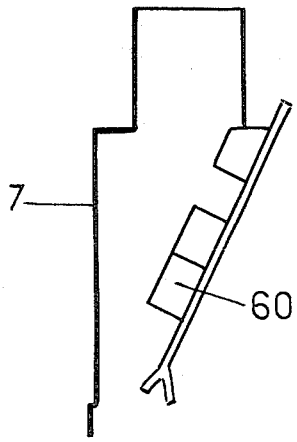
Fig. 10

OPEN FIRE CONVECTOR

This is a continuation of Ser. No. 40,383, filed May 18, 1979, abandoned.

BACKGROUND OF THE INVENTION

The invention relates to hot air generators intended to be mounted in an open fireplace and essentially constituted by a shallow closed conduit comprising on the ground a horizontal part forming a hearth and chamber for pre-heating of the air and, on the backwall of the fireplace, a vertical part in which the air is slowed down by baffles and achieves its final temperature.

More precisely, the invention relates to hot air generators of the type set out above in which one of the faces of the shallow conduit is constituted by plates of cast iron assembled together. The cast iron has remarkable qualities in this situation, but also has the inconvenience of the difficulty of moulding complex forms without use of a core, and thus in practice one cannot consider the direct moulding by pouring of the portions of the closed shallow conduit. Also, in the prior art, the second face of the shallow conduit is constituted by a wall of masonry. As a result, this type of hot air generator cannot be installed in a fireplace which has already been constructed. Furthermore, this solution does not give perfect airtightness and thermal insulation.

OBJECT OF THE INVENTION

The invention proposes to avoid these inconveniences, to reduce the cost of transportation of the elements, and to economise in the installation, by making it possible to construct the shallow conduit by simple assembly "in the dry", without use of tools, which a non-professional can carry out.

SUMMARY OF THE INVENTION

The hot air generator according to the invention is principally characterised in that the plates are provided on their internal face with plane elongated elements for guiding and channelling the hot air, two of which elements form the narrow faces of the shallow conduit. A cut out sheet of steel is applied on the plate and is bent in order to form edges which bear on the said two plane elongated elements, the cast iron plates and the sheets of steel being assembled together by simple interengagement "in the dry".

According to a preferred method of carrying out the invention, the closed conduit comprises a horizontal element forming a hearth, a first vertical element applied on the backwall of the fireplace, and a second vertical element constituted by the rear face of a smoke throat, itself formed by the assembly of elements of moulded cast iron, by interengagement in the dry, the said rear face being provided, at the external side of the throat, with plane elongated elements for guiding and channelling of the hot air.

Further features and advantages of the invention will appear from the following description:

BRIEF DESCRIPTION OF THE DRAWINGS

In the accompanying drawings:

FIG. 7 is a view in perspective elevation of modified construction of the generator, of which FIG. 8 illustrates the third conduit element, seen in perspective;

FIG. 9 is a view in longitudinal section of the said third element, and

FIG. 10 is a schematic view of the said third element in transverse cross-section.

DESCRIPTION OF THE PREFERRED EMBODIMENT

Figure 1:
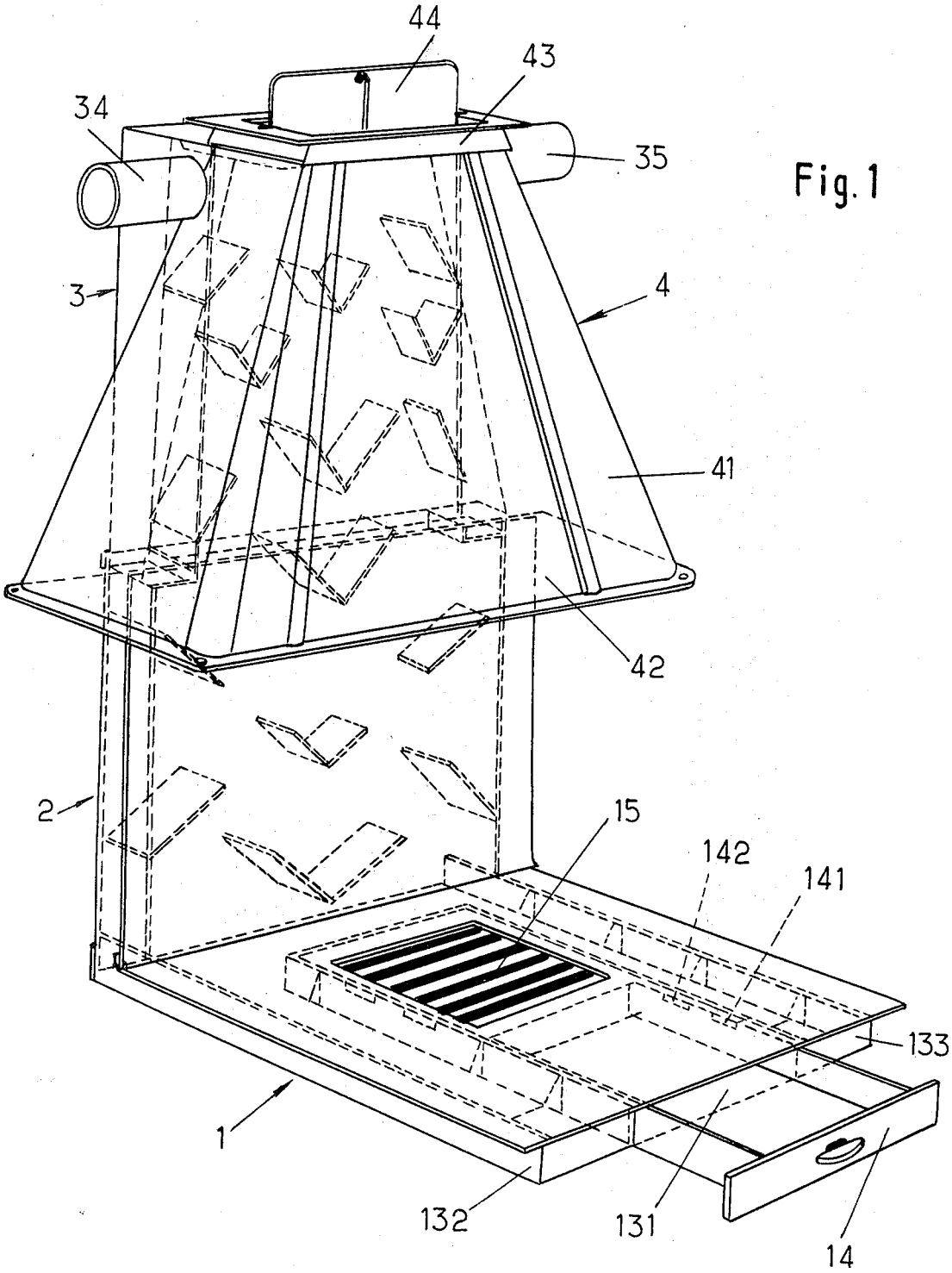
FIG. 1 is a view in perspective elevation of a hot air generator in conformity with a preferred embodiment of the invention.
Figure 4:
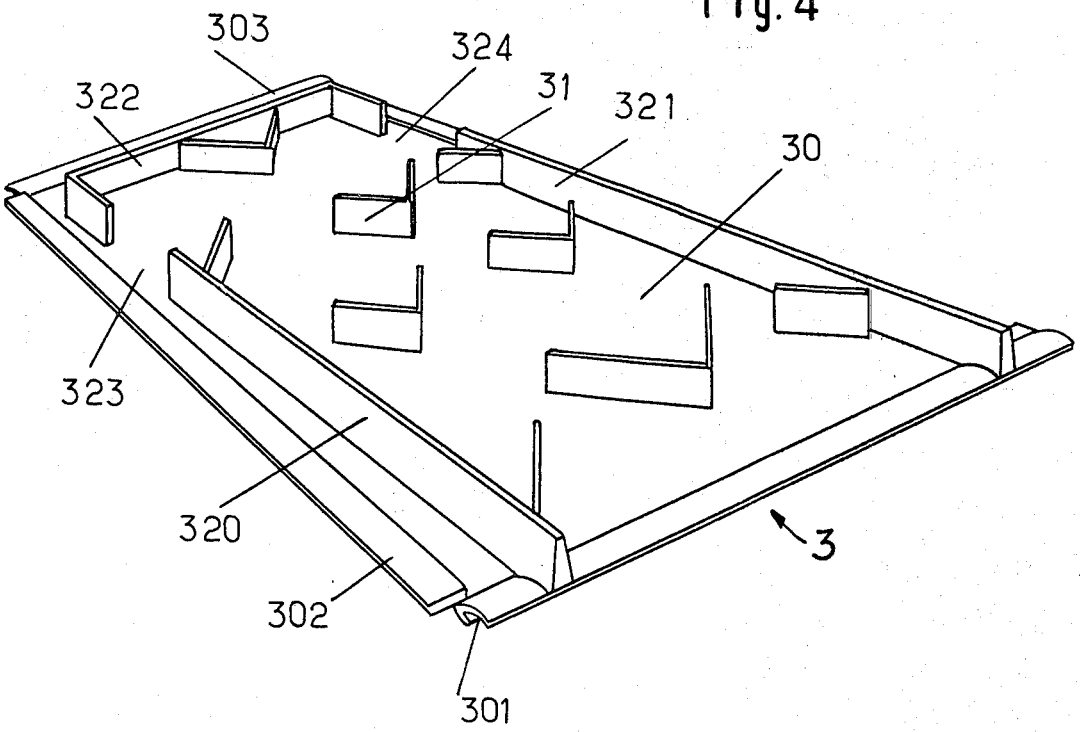
FIG. 4 is a view from below, in perspective, of the cast iron plate of the third conduit element of such a generator.
Figure 3:
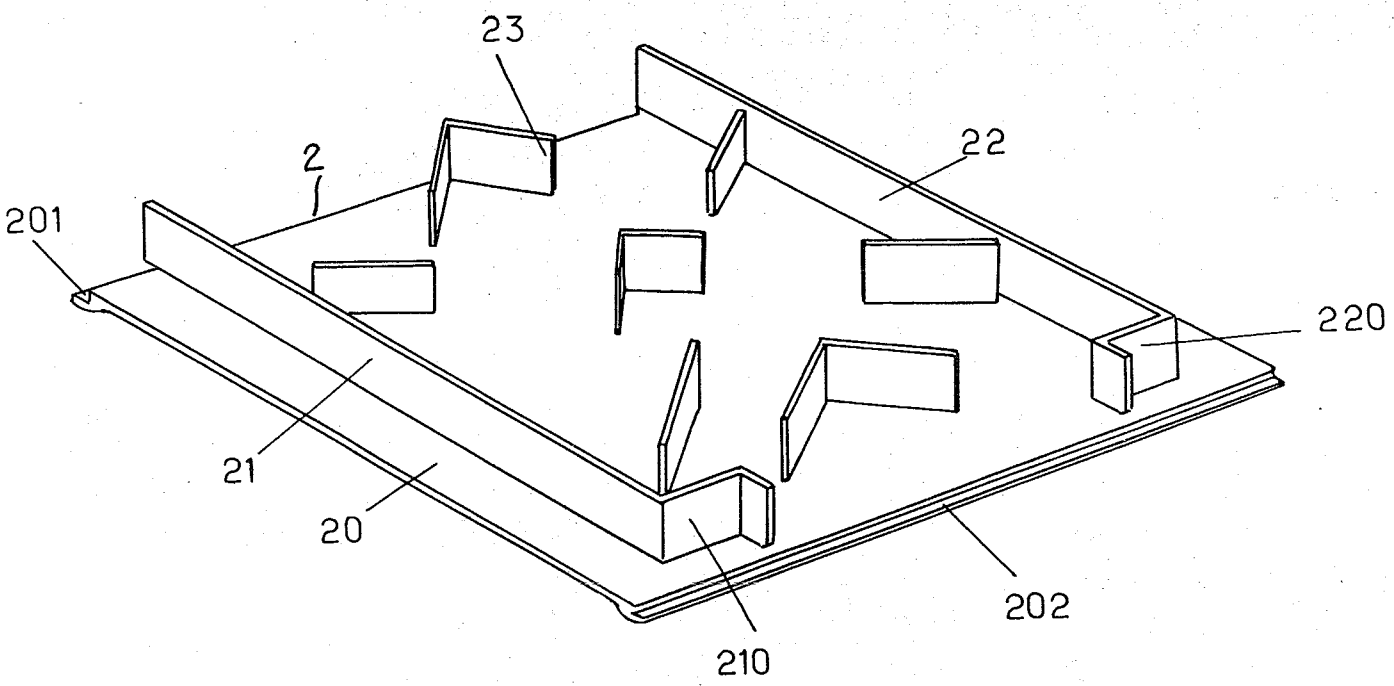
FIG. 3 is a view from below, in perspective, of the cast iron plate of the second conduit element of such a generator.

In FIG. 1 there is shown a hot air generator having the general appearance of a box composed of three parts fitted into each other, that is to say:

a horizontal element 1, seen from below in FIG. 2, and constituting the base of the hearth;

a first vertical element 2, seen from the rear in FIG. 3 and constituting the back wall of the hearth; and a second vertical element 3, seen from the rear in FIG. 4 and made fast to a smoke throat 4.

Each element is constituted by a plate of cast iron provided on one face with plane elongated elements serving as deflectors and/or partitions to form channels for the hot air, closed on the other face and on the edges by a sheet of steel applied on the plate and bent up to form edges which bear on two external longitudinal partitions, as will be seen from the following.

Figure 2:
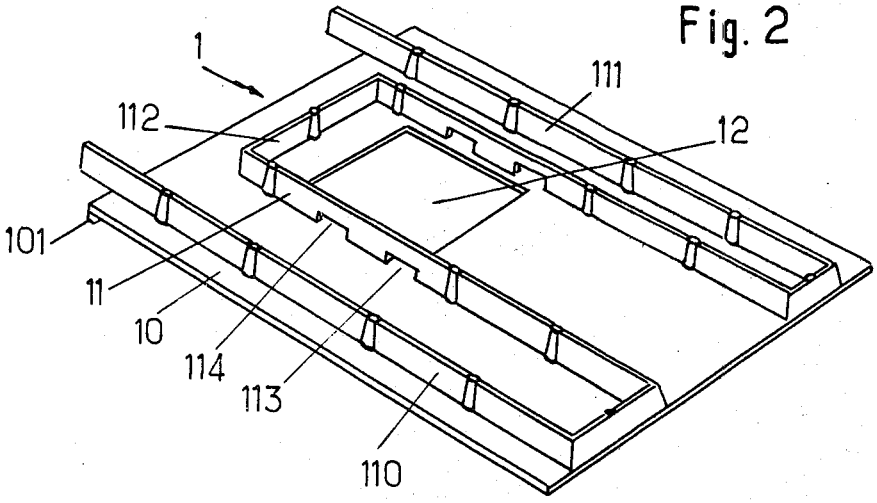
FIG. 2 is a view from below, in perspective, of the cast iron plate of the first conduit element of such a generator.

It can be seen, in FIG. 2, that the element 1 is formed of a sheet 10 of cast iron provided with an element 11 forming a continuous bent strip having two central branches and two external branches 110–111. By way of example, the plate 10 has the dimensions 600×550 mm, the interval between the two central branches of the element 11 is 225 mm., and the interval between each external branch and the corresponding edge of the plate is 45 mm. Between the central branches, the plate 10 is provided with a rectangular opening 12, of dimensions 220×200 mm., the edge of which parallel to the transverse branch 112 is placed at 50 mm. therefrom. Each central branch is provided with two small elongated windows, such as 113, 114, having a length of for example 50 mm., and separated by an interval of 50 mm. The thickness of the plate 10 is, for example, 10 mm., and the height of the element 11 is 50 mm. The free extremities of the branches 110 and 111 extend by 50 mm. beyond the rear edge of the plate 10.

Similarly, the element 2, FIG. 3, is formed of a cast iron plate 20 provided with two external strips 21, 22, and with elements forming deflectors, certain of which, such as 23, have the shape of chevrons. By way of example, the plate 20 has for dimensions: 500×550 mm. The strips 21–22 are situated at 50 mm. from the edges of the plate and their lower extremity extends slightly beyond (by 15 mm. for example). Their upper extremity is bent twice, to form an "L", of which the large horizontal branch, (in the actual position of the element 2, FIG. 1) has for example a length of 40 mm., and the small vertical branch (in FIG. 1) has for example a length of 12 mm. Thus, the distance between the two vertical branches of the two L's 210 and 220 is, in the example described, 360 mm.

In FIG. 4 it will be seen that the element 3 is composed of a plate 30 of cast iron in the form of a trapezium, the edges of which are shaped in such a manner as to constitute junction elements 301, 302, 303, and a fourth junction element, not visible in FIG. 4.

In the preferred manner of construction described, this plate constitutes the rear element of the throat 4 (FIG. 1) and this latter is in conformity with the description given in the French Patent Application filed on 7th April 1978 by the present applicant, for "Prefabricated metal throat for a chimney".

As in the example described in the said patent, the large base of the trapezium thus has a variable dimension according to the size of the throat, whilst its height measured between the two junction elements 301, and 303 is fixed, for all sizes, at 550 mm., and that the dimension of the small base is itself fixed at 300 mm.

Nevertheless, the face of the plate 30 externally of the throat is provided with deflectors such as 31 and with an element in the form of a bent strip having two longitudinal branches 320–321 joined by a transverse branch 322, the branches 320 and 321 being respectively interrupted by openings 323 and 324 the upper edges of which are separated, in the example considered, by a distance of 265 mm. The branches 320 and 321 are separated at their lower extremities by a distance fixed at 375 mm., irrespective of the dimension of the large base of the plate.

Figure 5:
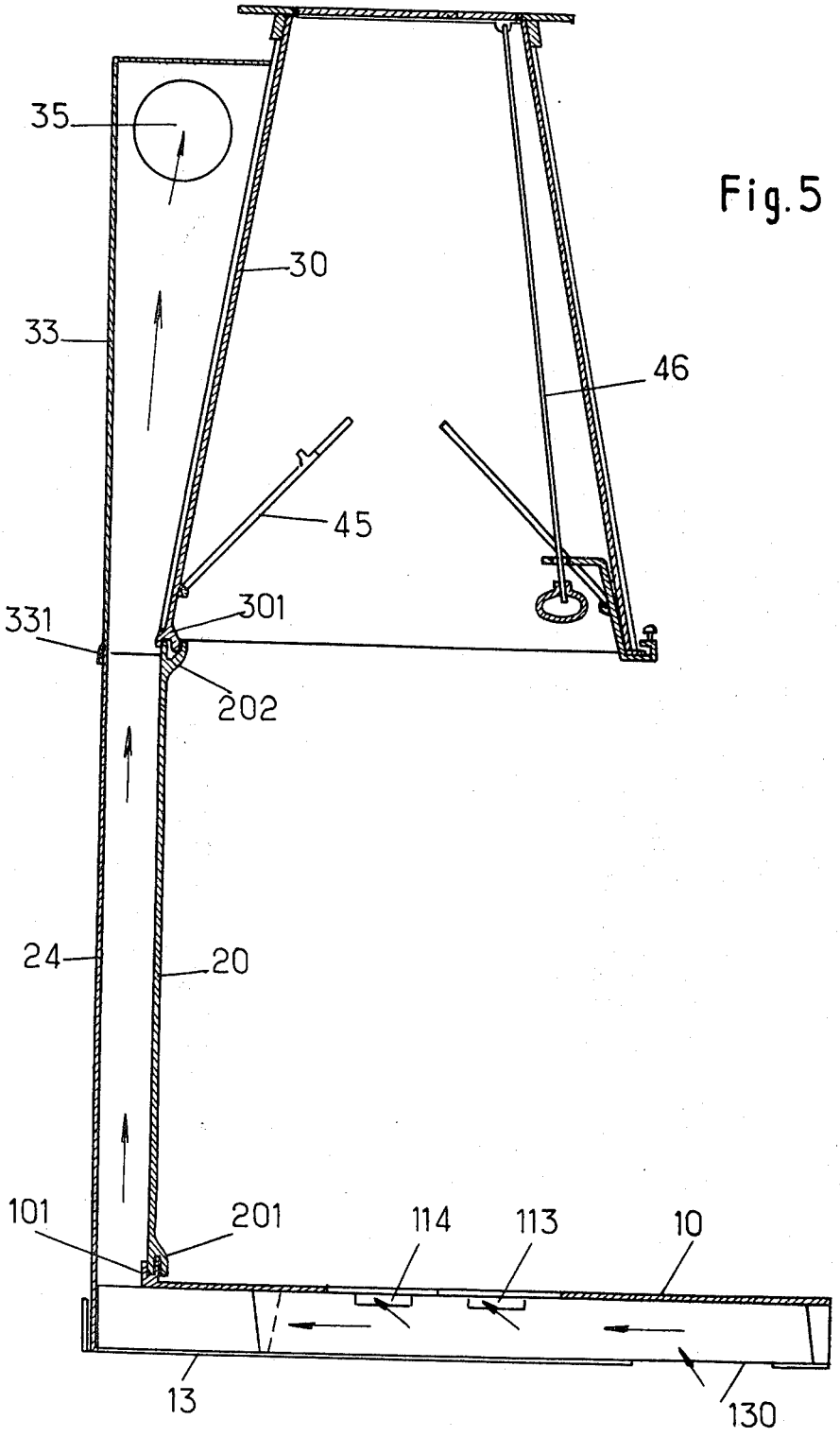
FIG. 5 is a view of the generator, in section on a vertical plane.

Referring now principally to FIG. 5, it will be seen that the plates 10-20-30 seat one into the other. The plates 10 and 20 are rectangular and of the same width. The plate 10 comprises at its rear edge a junction element 101 (see also FIG. 2) which cooperates with a junction element 201 with which the lower edge of the plate 20 is provided (see also FIG. 3). The junction thus formed is of the type illustrated in FIG. 3 of the patent mentioned above, and assures airtightness and compensation for the effects of expansion.

The junction element 301 (see also FIG. 4) of the plate 30 cooperates with a junction element 202 (see also FIG. 3) with which the upper edge of the plate 20 is provided in order to form an airtight junction identical to the preceding one.

A sheet of steel 13 is cut out and bent in order to form the first box portion 1 with the plate 10. It is provided at 130 with two openings serving for entry of external air, and at 131 (FIG. 1) with a forward opening which permits the introduction of a tray 14 which slides between the internal faces of the two internal branches of the element 11 (FIG. 2). As can be seen in (FIG.) 1, the bent lateral edges 132 and 133 of the element 13 bear against the external faces of the branches 110 and 111 of the element 11 (FIG. 2).

Similarly, a sheet of steel 24 (FIG. 5) is cut out and bent up to form the second box portion 2 with the plate 20. The principal face, parallel to the plate 20, of the sheet 24 rests at the lower part on the free extremities of the branches 110 and 111 (FIG. 2) and on the internal face of the bent edge of the element 13 (FIG. 5). The bent vertical edges perpendicular to the plate 20, of the sheet 24, rests on the external face of the elements 21 and 22 (FIG. 3). As the distance between the elements 110 and 111 is slightly greater (by 5 mm. for the example described) than the distance between the lower extremities of the elements 21 and 22, these latter can become jammed, at a right angle, between the lower extremities of the elements 21 and 22. The putting into position and the joining of the two box portions 1 and 2 thus takes place with precision and without the need for use of any assembling instrument.

Figure 6:
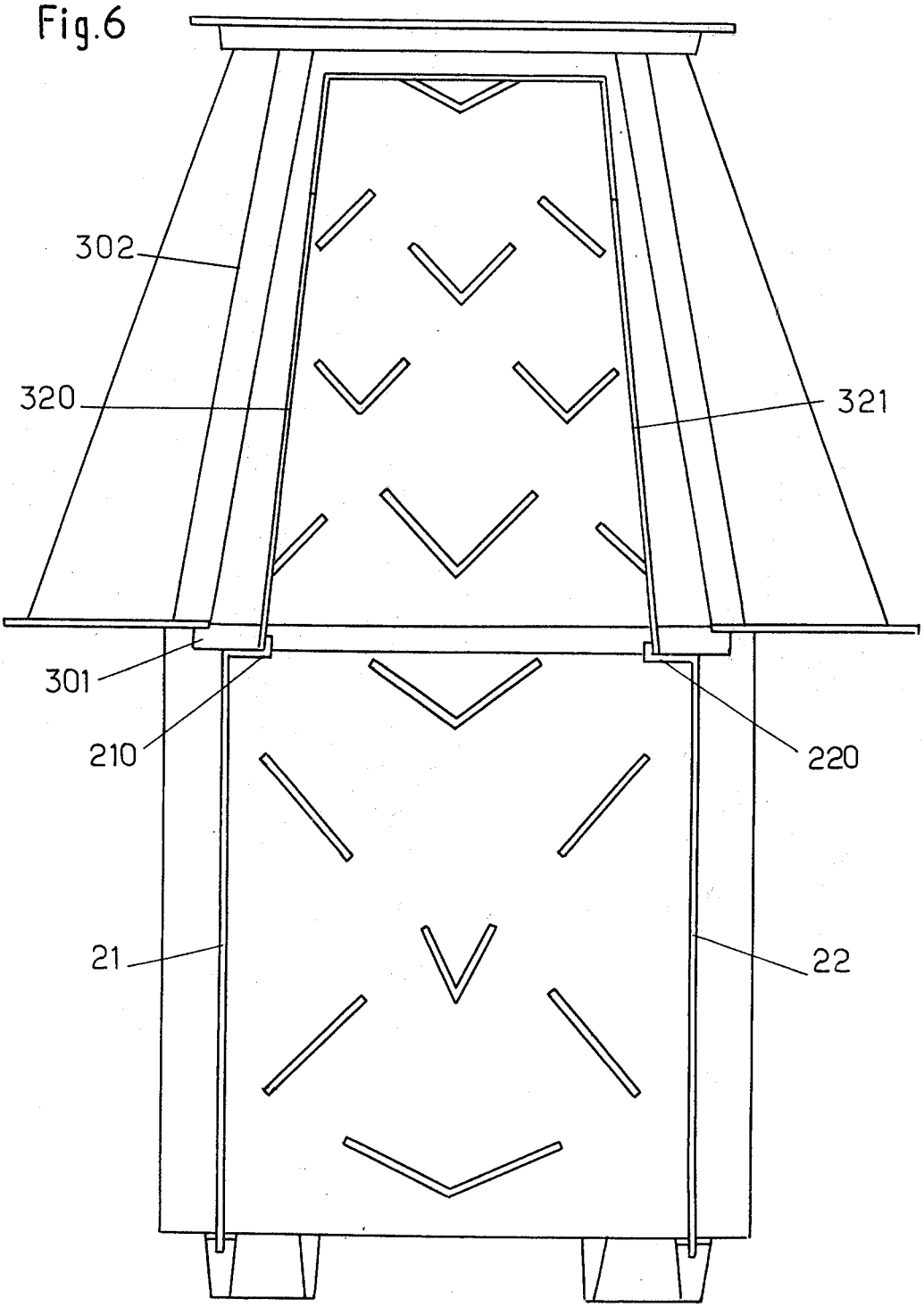
FIG. 6 shows, in elevation, and seen from the rear, the whole unit constituted by the cast iron plates and the plates of the throat assembled.

Finally, a sheet of steel 33 (FIG. 5) is cut out and bent up to form the third portion of the box with the plate 30. The base of this sheet 33 is shaped at 333 to constitute a junction with the upper edge of the sheet 24 and its inclined lateral edges press against the external faces of the elements 320 and 321 (FIG. 4). As has been indicated above, although the base of the rear and front faces of the throat have a variable dimension according to the size, the elements 320 and 321 form a trapezium of fixed dimensions, so that the sheet 33 can be shaped once and for all, and so that the interval between the two elements 320 and 321 is substantially equal to the interval, of 360 mm., between the vertical branches of the L's 210 and 220 (FIG. 3). As a result, as shown in FIG. 6, the said L's jam themselves between the extremities of the elements 320 and 321, thereby offering a continuous guidng surface for the positioning of the sheets 24 and 33.

Two conduits 34 and 35, for the outlet of hot air, (FIG. 4–5) are mounted around openings formed in the sheet 33 and communicate with the interior of the portion 3 of the box through the openings 323 and 324 (FIG. 4).

The throat 4 is only differentiated from that described in the above-mentioned patent by channelling and deflecting elements fast to the external face of its central rear panel 30. It is thus unnecessary to give a detailed description. It will be remembered nevertheless that it is characterised in that it is obtained by the assembly, by a single interengagement, of two identical elements of a first type (such as 41, FIG. 1) with two identical elements of a second type (such as 42) in order to constitute a principal body in the form of a frustum of a regular pyramid having a rectangular base, the elements of the first type having C-sections in planes parallel to the bases and each forming a terminal face and two return angles of the throat, whilst the elements of the second type join together the said return angles, in order to form front and rear faces of the throat, the said elements being of moulded cast iron and the element of the second type having the shape of a trapezium of which the oblique sides are more or less inclined with respect to the base as a function of the size of the chimney, in such a manner that the horizontal branches of the said C-sections have a length not exceeding a predetermined limit compatible with the moulding of the cast iron, without use of a core. Its principal body is capped by a cap 43 of moulded cast iron provided with a closure valve 44 (FIG. 1), an anti-return-flow plate 45 (FIG. 5) and a control rod 46 for the closing of the closure valve.

Returning to FIG. 1, it will be seen that a grille 15 is rested on the opening 12 of the plate 10, shown in FIG. 2. This grille supports the wood which serves as fuel and permits passage of the ashes which fall into the drawer 14. This latter, shown in open position in FIG. 1, comprises on each lateral face two openings 141–142 which can coincide with the openings 113–114 (FIGS. 2 and 5) when the drawer is slightly open (by 50 mm. for the example described). In this position, the air which enters the drawer (principally through the openings 130, FIG. 5) can pass into the channel bounded by the element 11 (FIG. 2). The hot air generator can then be put into operation. To cut the feed, it is only necessary to close the drawer 14 completely. The opening 141 then comes into a position opposite to the space between the openings 113 and 114 and is thus masked, whilst the opening 142 is masked by the upper portion of the central branches of the element 11. It is thus possible to obtain an adjustment by placing the drawer in an intermediate position.

The principle of operation of the generator described and shown in the following: the portion 1 of the box serves as a pre-heating chamber for the external air. The hot air follows the rising path shown by the arrows in FIG. 1 and is slowed down by the deflectors forming baffles. The vertical path has a considerable height, which improves the yield. When the drawer is closed, there is a slowing of the fierceness of the fire, and extinction. The exits of the conduits 34 and 35 are closed and the apparatus then operates like a normal fireplace, provided with the necessary throat.

Figure 7:
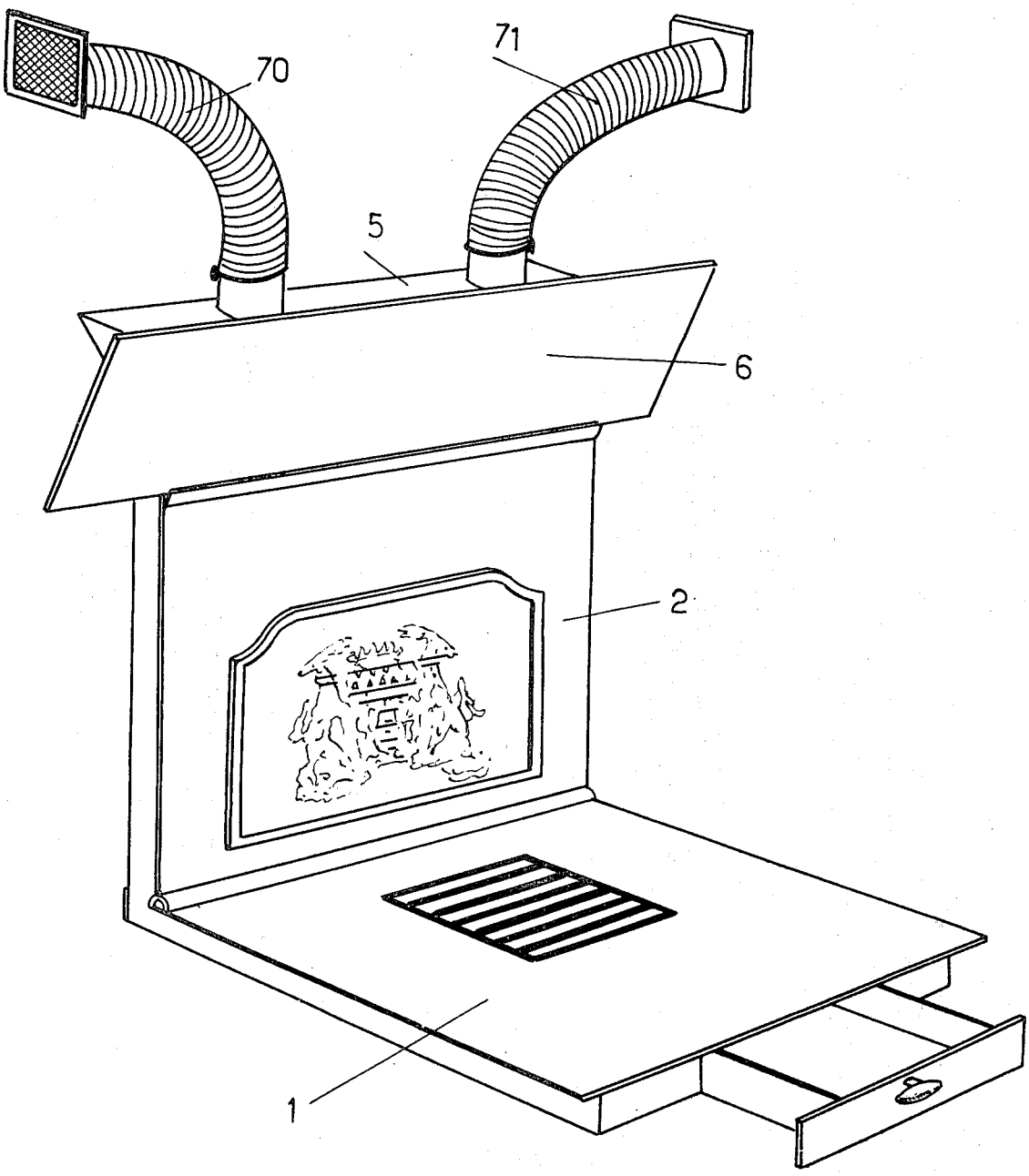

It will be noted that the apparatus forms a single unit, the box within which the hot air circulates being entirely closed without requiring the use of walls of masonry. As a result it can be installed in an existing fireplace, without having to carry out any demolition thereof. Nevertheless, if the latter already normally comprises a throat, use will then be made, in this case, of the simplified variant shown schematically in FIG. 7.

The elements 1 and 2 are identical to those of the embodiment of FIGS. 1 to 6, but the upper vertical element 5 is shaped to be lodged in the throat of an already constructed fireplace. It is composed, as is shown in FIGS. 8, 9 and 10, of a plate 6 of cast iron provided, on its internal face, with deflector elements such as 60 and a casing 7 of sheet steel in the form of a truncated pyramid, provided with air outlet conduits 70–71.

The plate 6 joins at its base to the plate of the element 2 by a junction of the same type as in the preceding embodiment, (junction 62, FIG. 8). The base of the casing 7 forms a frame which meets with the upper edges of the sheet of metal which closes the portion 2 of the box.

The box portions 1 and 2 can be fitted into the base and back wall of the fireplace, if this latter is in the course of construction. If not, they can be applied in any manner on the existing walls, the shoulder formed by the sheet of metal and the projecting edges of the plates of cast iron being able to serve to engage a bonding layer of refractory cement or brick.

The assembly of the elements takes place in the dry state and without the use of any fixing tool. The airtightness against dust and air is much better assured by the joints between the sheet metal elements and the plates of cast iron, than would be the case with shallow conduits constituted by plates of cast iron provided with projecting air channelling and deflecting elements directly embodied in a masonry wall.

I claim:

1. A hot air generator comprising a conduit, said conduit being characterized by a horizontal section thereof mounted on the base of the fireplace, a first vertical section detachably connected at one end to one end of the horizontal section and a second vertical section detachably connected to the other end of the first vertical section, said vertical sections extending along the back wall of the fireplace, said sections providing a continuous passageway through said conduit, the second vertical section being closed at its extreme upper end but provided with outlet openings at its sides, said horizontal section being provided internally thereof with an upstanding continuous guiding and channeling strip shaped to provide a pair of spaced parallel central legs and a pair of legs respectively spaced outwardly of the central legs, each of said central legs being provided with openings aligned with those in the other central leg of the pair, an opening in the upper wall of the horizontal section provided with a grille, a drawer slidably mounted within the horizontal section between the pair of central legs and beneath the grille, said drawer having at least two pairs of opposed openings in the sides thereof in such a manner as to be placed opposite a selected portion of the area of the openings of the said two central legs.

2. A hot air generator, according to claim 1, wherein said drawer and said drawer openings are so arranged that the complete closure of the drawer cuts off the passage of air through the said drawer openings.

* * * * *